United States Patent [19]

Hübner et al.

[11] 4,367,556

[45] Jan. 4, 1983

[54] ROTARY-ANODE X-RAY TUBE

[75] Inventors: Horst Hübner; Bernhard Lersmacher, both of Aachen, Fed. Rep. of Germany

[73] Assignee: U.S. Philips Corporation, New York, N.Y.

[21] Appl. No.: 189,487

[22] Filed: Sep. 22, 1980

[30] Foreign Application Priority Data

Oct. 12, 1979 [DE] Fed. Rep. of Germany ..... 2941396

[51] Int. Cl.[3] ..... H01J 35/10

[52] U.S. Cl. ..... 378/125; 378/127; 378/144

[58] Field of Search ..... 313/60, 149; 378/125, 378/127, 141

[56] References Cited

U.S. PATENT DOCUMENTS 3,710,162 1/1973 Bougle ..... 313/60

3,842,305 10/1974 Braun ..... 313/60

4,144,471 3/1979 Hartl ..... 313/60

*Primary Examiner*—Robert Segal

*Attorney, Agent, or Firm*—Robert J. Kraus

[57] ABSTRACT

In a rotary anode X-ray tube, comprising an anode disc which is mounted on a rotary shaft and which comprises a basic body of graphite, the anode disc is subject to such loads during the operation of the X-ray tube that a connection between the disc and the shaft is liable to fracture if it consists of pressed and sintered graphite. In order to counteract fracturing, the basic body is connected to the shaft by a bushing of pyrolytic or microporous graphite. A pyrolytic graphite bushing may be formed by deposition from the gaseous phase in situ or on a mandril, and should have a radial direction of growth. Both materials have a high strength and, moreover, a lower thermal conductivity in the radial direction. As a result, not only is the strength improved, but the thermal loading of the shaft bearings is also reduced.

7 Claims, 2 Drawing Figures

ROTARY-ANODE X-RAY TUBE

BACKGROUND OF THE INVENTION

The invention relates to a rotary-anode X-ray tube, comprising an anode disc which is mounted on a rotary shaft and which comprises a basic body of graphite, and also relates to a method of manufacturing an anode disc for such an X-ray tube.

German Auslegeschrift No. 1,764,042, which corresponds to U.S. Pat. No. 3,539,859, describes such an X-ray tube wherein the basic body consists of pressed and sintered graphite. In comparison with anode discs having a basic body of molybdenum or a molybdenum alloy, an anode disc of graphite offers the advantage that it is particularly light, has a thermal capacity and also a high thermal emissivity.

It is a drawback of this known X-ray tube that the connection between the anode disc and the rotary shaft, which is driven by a motor, fractures after a relatively short operating time. Because of the low mechanical strength and brittleness of pressed and sintered graphite, mechanical loading—for example tangential loading during starting and stopping of rotation—will cause fracturing of the connection.

SUMMARY OF THE INVENTION

It is an object of the invention to improve the mechanical strength, notably at the area where the rotary shaft and the anode disc are connected. According to the invention, a rotary anode X-ray tube as set forth in the opening paragraph is characterized in that the basic body is connected to the rotary shaft by a bushing of pyrolytic or microporous graphite (as herein respectively defined).

Pyrolytic graphite is to be understood to mean herein graphite which is formed by thermal decomposition of carbon compounds, notably by deposition of carbon from the gaseous phase of these carbon compounds for example as described in the magazine "Chemie-Ingenieur Technik", Edition 39, Vol. 14, 1967, pages 833–842. Microporous graphite is to be understood to mean herein graphite which is produced by the heating of hard fabrics which consist mainly of phenolic or cresol resins reinforced with cotton fabrics, to a temperature above 800° C. in a non-oxidizing atmosphere, for example, as described in German Offenlegungsschrift No. 26 48 900 corresponding to U.S. application Ser. No. 845,275, now abandoned. Both kinds of graphite are much stronger than pressed and sintered graphite, so that the strength of the connection to the rotary shaft is higher. Both graphites have a very low thermal conductivity too, so that the shaft and the bearings connected thereto are protected against overheating. If the bushing is of pyrolitic graphite, it is essential that its growth direction is radial, because pyrolytic graphite has this low thermal conductivity only in its growth direction. This radial growth direction can be readily effected during the manufacture of such a bushing for example, by depositing the pyrographite in a cylindrical bore of the anode disc. Surfaces of higher thermal conductivity then extend concentrically with respect to a rotary shaft inserted into the bore.

Preferably the bushing is non-circular. This is particularly important for bushing of pyrolytic graphite, because pyrolytic graphite has a laminar structure with an associated interlaminar shearing strength which is in the order of magnitude of some $N/cm^2$; the more nearly perfect the orientation thereof is in a crystallographic sense, the smaller is the adhesion between individual layers of layer stacks. Because the bushing is subject to high tangential loads during the operation of a rotary anode X-ray tube, the risk of occurrence of stresses which exceed the low interlaminar shearing strength and which lead to interlaminar fractures is comparatively high. If the bushing is non-circular, the tangential forces and the individual layer or layer stacks in the pyrographite bushing no longer coincide, and this effect is reduced. Either the inner contour or the outer contour of the bushing may deviate from a circular shape, but preferably they both deviate. Although this may unbalance the anode disc, the unbalance is comparatively small, because the mass is asymmetrically distributed only in the direct vicinity of the shaft. This unbalance can also be kept small by shaping the non-circular bushing symmetrical with respect to the rotary shaft (for example square).

If the bushing is of pyrolytic graphite it is suitably manufactured by the pyrolytic deposition of carbon from the gaseous phase directly in a bore or recess in the anode body. During the pyrolytic deposition of carbon from the gaseous phase, the substrate on which the pyrolytic graphite layer is to be deposited, in this case the bore in the body of the anode disc, is typically heated to a temperature of approximately 2000° C. in the direct flow path in a hydrocarbon atmosphere, for example, of methane or benzol, at pressure of up to 100 Torr. Carbon is later deposited in the bore. Any deposits on other parts of the anode disc can subsequently be removed, if necessary, for example, by a chipping operation.

In an alternative method of manufacturing a bushing of pyrolytic graphite the bushing is formed by the pyrolytic deposition of carbon from the gaseous phase onto a mandril. Subsequently, possibly after mechanical working, the bushing is soldered to the anode disc, for example with a high-melting-point solder containing zirconium/nickel or molybdenum/nickel. Soldering is preferably performed by reactively depositing a high-melting-point metal solder from the gaseous phase between the bushing and the anode disc.

BRIEF DESCRIPTION OF THE DRAWING

A preferred embodiment of the invention will now be described, by way of example, with reference to the accompanying diagrammatic drawings, in which.

DESCRIPTION OF THE PREFERRED EMBODIMENTS

Figure 1:
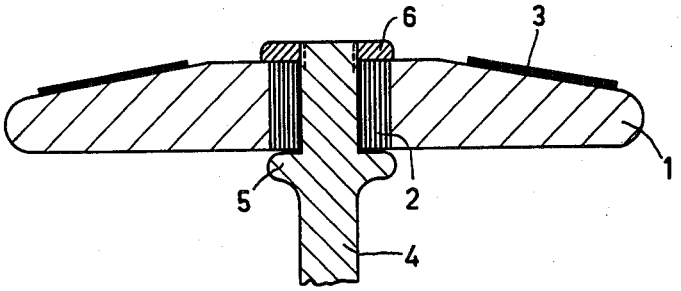
FIG. 1 is a longitudinal sectional view of an anode disc and part of a shaft in an X-ray tube embodying the invention.

The anode disc comprises a basic body 1 made, for example, of electrographite. At the area of the focal path it comprises a target layer 3 of a tungsten rhenium alloy. In the centre of the anode disc there is provided a bore or recess in which is a bushing 2 of microporous or pyrolytic graphite.

The bushing 2 can be made of pyrolytic graphite directly in known manner by local, pyrolytic deposition of carbon from carbon compounds in the gaseous phase in the bore or recess of the basic body 1. Due to the different coefficients of expansion of electrographite on the one and pyrographite, a very firm connection is established between the basic body 1 and the bushing 2, because the electrographite body shrinks onto the pyrographite bushing during the cooling from the deposition temperature (approximately 2000° C.) to the ambient temperature. The firm connection thus obtained is not adversely affected by the temperatures occurring during operation of the X-ray tube, in which the connection (1, 2) may reach a temperature of approximately 1000° C.

It is alternatively possible to manufacture the bushing separately with a wall thickness preferably between 1 and 5 mm. To this end, carbon can be deposited from a hydrocarbon atmosphere, at a pressure of 100 Torr and a temperature of approximately 2000° C., onto a mandril whose shape corresponds to the shape of the shaft on which the bush is to be mounted.

During such a manufacture of the bushing, as during the direct deposition of carbon in the bore or recess of the anode disc, an orientation of the pyrolytic graphite is obtained such that the surfaces of higher thermal conductivity extend concentrically with the shaft and the radial thermal conductivity is very low. The outer parts of an anode disc formed by the basic body of electrographite with an outer diameter of 120 mm and a bushing having an outer diameter of 20 mm and a wall thickness of 4 mm were heated to a temperature of approximately 1500° C. The temperature of the area within the bushing remained lower than 500° C., while inside the bushing a temperature gradient of more than 100° C./mm occured in the radial direction.

If the bushing is separately manufactured, it is then connected to the basic body preferably by soldering. For this purpose, use can be made of conventional soldering techniques, for example with high-melting-point solders containing zirconium/nickel or molybdenum/-nickel. The provision of the solder at the area where the bushing is connected to the basic body can also be accomplished by diffusion soldering, the metallic solder then being deposited from the gaseous phase.

As is shown in FIG. 1, the anode disc is connected to a shaft 4. The shaft 4 is inserted through the bushing 2 so that the lower side of the basic body or of the bushing bears on a thickened flange portion 5 of the shaft. The end of the shaft comprises a thread which is engaged by a nut 6. When the nut is tightened, the anode disc is pressed against the flange portion 5.

Figure 2:
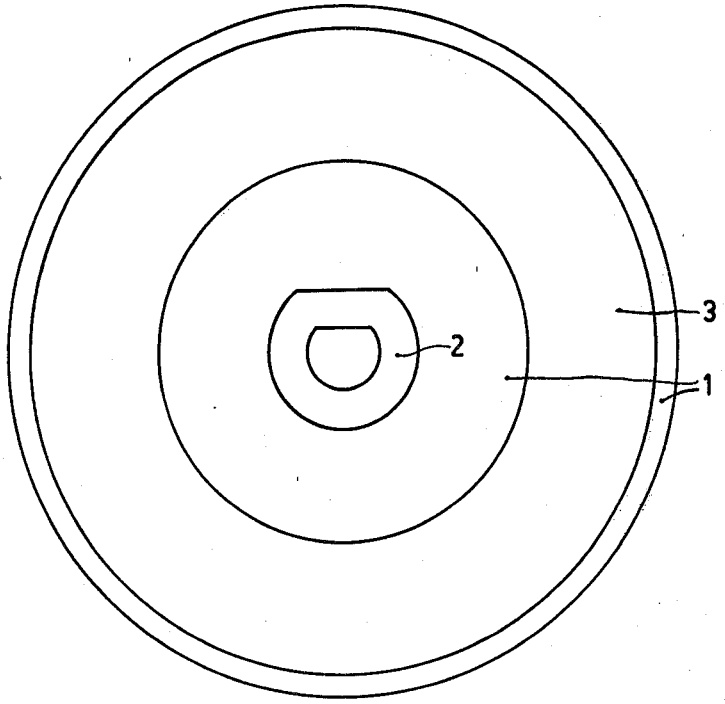
FIG. 2 is a plan view of the anode disc shown in FIG. 1.

As has already been stated, a bushing of pyrographite preferably has a non-annular shape, because the possibility of interlaminar fractures can thus be reduced. Such fractures would be stimulated by an annular cross-section because of the low tangential shearing strength of the pyrolytic graphite in the direction perpendicularly to its growth direction. The embodiment shown in FIG. 2 comprises a bushing 2 whose outer and inner contour are each approximately the shape of a circle with a segment cut off, so that an approximately uniform wall thickness is obtained. The bore or recess in the centre of the basic body 1 and the shaft, at least at the area where it is connected to the bush, should be similarly-shaped.

What is claimed is:

1. A rotary anode X-ray tube including an anode comprising a graphite disc having a central opening, and a bushing in the opening affixed to the disc to facilitate mounting of the anode on a shaft, said bushing comprising pyrolytic graphite having a radial growth direction with respect to the center of the opening.

2. A rotary anode X-ray tube as in claim 1 wherein said bushing is non-annular.

3. A rotary anode X-ray tube as in claim 1 or 2 where said bushing is formed from pyrolytic graphite deposited on the surface of the disc inside the opening.

4. A rotary anode X-ray tube as in claim 1 or 2 where said bushing is affixed to the disc by means of solder.

5. A rotary anode X-ray tube as in claim 4 where said solder is a high melting point metallic solder deposited on the surface of the disc inside the opening.

6. A rotary anode X-ray tube including an anode comprisng a graphite disc having a central opening, and a bushing in the opening affixed to the disc to facilitate mounting of the anode on a shaft, said bushing being formed from microporous graphite.

7. A rotary anode X-ray tube as in claim 6 where said bushing is non-annular.

* * * * *